US006112909A

United States Patent [19]

Moseley

[11] Patent Number: 6,112,909

[45] Date of Patent: Sep. 5, 2000

[54] CAP STORAGE AND DISPLAY RACK

[76] Inventor: Randall C. Moseley, 4240 Lost Hills Rd., Unit 2203, Agoura Hills, Calif. 91301

[21] Appl. No.: 09/201,404

[22] Filed: Nov. 30, 1998

[51] Int. Cl.[7] ..... A47G 25/10; A47F 7/06; F16B 21/00

[52] U.S. Cl. ..... 211/32; 211/30; 403/322.2

[58] Field of Search ..... 211/32, 33, 30; 403/328, 322.2, 261, 256, 247

[56] References Cited

U.S. PATENT DOCUMENTS

| | | | |
|---|---|---|---|
| D. 151,372 | 10/1948 | Keefer | 211/32 X |
| 503,949 | 8/1893 | Crouch | 211/32 |
| 821,364 | 5/1906 | Jessel | 211/32 X |
| 1,387,765 | 8/1921 | Colonna | 211/33 X |
| 1,984,827 | 12/1934 | Derman | 211/32 X |
| 2,034,924 | 3/1936 | Simon | 211/32 X |
| 2,094,810 | 10/1937 | Oppenheimer | 211/33 |
| 2,709,004 | 5/1955 | Dahlstrom | 211/33 X |
| 5,480,073 | 1/1996 | LaManna | 211/32 X |
| 5,921,403 | 7/1999 | Coffaro | 211/32 |

*Primary Examiner*—Daniel P. Stodola
*Assistant Examiner*—Erica B. Harris
*Attorney, Agent, or Firm*—Albert O. Cota

[57] ABSTRACT

A rack (10) for storing and displaying a plurality of caps, and particularly sport caps (150). The rack (10) consists of three elements: a base (12), a cap support (40) and a base/cap support attachment rod (60). The base (12) can be attached to a substantially flat surface (152) in either a vertical or a horizontal orientation by screws (30) or an adhesive (32) and preferably has a length to accommodate six sport caps. The cap support (40) has a hemispheric shape which is sized to securely hold and display the cap(s) (150). The base/cap support attachment rod (60), which can be made from a tubular or a solid rod includes a base end (62) and a cap end (84). The base end (62) terminates with a structure (90) which allows the base end (62) to be attached and secured to the base (12) in either a vertical or a horizontal orientation. The cap end (84) is dimensioned to be attached and secured to the cap support (40).

2 Claims, 3 Drawing Sheets

CAP STORAGE AND DISPLAY RACK

TECHNICAL FIELD

The invention pertains to the general field of hat and cap racks and more particularly to a rack which attaches to a vertical or horizontal surface and that is designed to store and display a plurality of caps and especially sport caps.

BACKGROUND ART

One of the most popular and constantly growing activities of young and old people alike is the collecting of sports memorabilia. This hobby, as it is popularity referred to, includes not only the collecting of trading cards, which have been bought, sold and traded for decades, but also such items as balls, jerseys, and, especially baseball-style caps. Although baseball-style caps are usually associated with baseball, most major sports now also utilize these types of caps; so it is just as common to see a cap emblazoned with the logo of the Los Angeles Dodgers baseball team as it is the Dallas Cowboys football team.

As a result of the popularity of baseball caps, and the subsequent "free" publicity a team, a club or a business establishment can receive from people wearing their cap, a great deal of time and energy is dedicated to making quality, multi-colored, high graphic designs on the caps. The caps are specially designed to attract attention. This has led to a pronounced collectability of baseball caps. In addition to caps with almost every major sports team, there are also caps that commensurate special events such as a world series or superbowl. Also many companies, from large multi-national conglomerates to small retain stores have discovered the use of baseball caps to display their name or a message.

One of the problems that affects baseball cap collectors is how to display their collection. Due to the design of most baseball caps it is difficult to maintain them in the same position as when they are worn. If a viewer is unable to see the design and/or name on the cap the whole purpose of collecting and displaying the caps is defeated. The solution is to provide a display means that is specially designed to accept the hemispheric shape of a baseball cap. A display means such as this would allow a collector, and also non-collectors and retain outlets, to easily and correctly place a baseball cap in a position that ensures the cap will be completely visible when observed.

A search of the prior art did not disclose any patents that read directly on the claims of the instant invention, however the following U.S. patents are considered related:

| U.S. PAT NO. | INVENTOR | ISSUED |
|---|---|---|
| 5,566,837 | Lema | 22 October 1996 |
| 5,348,166 | Lema | 20 September 1994 |
| 5,038,941 | Bastiaansen | 17 August 1991 |
| 5,002,190 | Moreland | 26 March 1991 |

The U.S. Pat. No. 5,566,837 discloses a hat rack including a vertical rod with a loop of the top for hanging the rack on a wall. Separate rack sections are attached to the vertical rod and spaced apart at intervals, each section for storing a single cap. A section includes two rods extending out from the vertical rod at an angle to each other forming a triangular-shaped cap support structure with a tie rod extending between them. Each rod has an upwardly protruding end for captivating a cap visor placed on the rods. A short rod is positioned above each pair of outwardly protruding rods that is spaced above the protruding rods that is useful for supporting the top portion of the cap.

The U.S. Pat. No. 5,348,166 discloses a ball cap storage rack consisting of a wire or rod stock frame. The frame includes a plurality of rods configured to form an elongated, generally rectangular-shaped back with side capture bars and a pair of hooks at one end. The back has a width slightly narrower than the width of a typical baseball cap visor and is adapted to have its length running vertically when in normal use. Two additional sets of rods are arrayed along opposite sides of the back to form side capture rails, and define visor edge receiving openings. The upper ends of the rails are deformed to provide a closet pole hanger at the upper end of the rack, and the lower ends are deformed to form the capture fingers at a lower portion of the device. To store a plurality of baseball caps in the rack, the caps are placed with their visors flat against the back with the soft cap portion collapsed forwardly and the bill of each successive cap slipped behind the preceding one and the folded cap nested against the same part of the preceding cap.

The U.S. Pat. No. 5,038,941 discloses a hat clamp and rack that is used for holding and displaying baseball-style caps. The hat clamp holds the hat in a position such that the front portion of the hat, which usually includes some form of advertisement, is fully visible for unobstructed viewing.

The U.S. Pat. No. 5,002,190 discloses a hat rack adapted to display at various positions a plurality of different peak caps. The rack includes a single longitudinal element carrying a plurality of secondary elements specially therealong, with each of the second elements carrying at least two members, preferably a curved U-shaped member at the distal end of the second element. The rack also includes a vertical U-shaped member, relative to the second longitudinal element, located midway therealong the U-shaped elements which are adapted to specifically carry the peak and body of a single cap.

For background purposes and as indicative of the art to which the invention relates reference may be made to the patents issued to:

| PATENT NO. | INVENTOR | ISSUED |
|---|---|---|
| 5,630,516 | Helman | 20 May 1997 |
| Des. 369,910 | McCarty | 21 May 1996 |
| Des. 364,979 | Thomas et al | 12 December 1995 |
| 5,411,144 | Deupree | 2 May 1995 |

DISCLOSURE OF THE INVENTION

The cap storage and display rack is designed to the attached to a substantially flat surface, such as a wall or door, in either a vertical or horizontal orientation. The rack is particularly designed to store and display a baseball-type cap.

In its most basic design, the cap storage and display rack consists of the following three elements:

a) a base having a front surface, a rear surface, an upper edge, a lower edge, a first side edge and a second side edge, b) a cap support, which has an upper surface and a lower surface, and that is dimensioned to allow a cap, and especially a sport cap, to be placed over the cap support, and c) a base/cap support attachment rod, having a base end and a cap end. The base end includes a means for being attached and secured to the base in either a vertical or horizontal orientation. The cap end includes a means for being attached and secured to the cap support.

In view of the above, it is the primary object of the invention to provide a means by which a person can display one or more baseball-type caps in a manner that allows the indicia, i.e., a logo located on the front of the cap to be clearly visible to an observer.

Another object of the invention is to provide a display means that can be mounted to a substantially flat surface, such as a wall, which can provide an optimum view.

Yet another object of the invention is to allow a person to alter the position of the display means from vertical to horizontal, thereby permitting the caps to be displayed in a wider variety of locations.

Still another object of the invention is to provide collectors and others a means by which to protect and store baseball-type caps. In addition to providing an excellent means by which a person can display baseball-type caps for viewing, the invention also allows the caps to be stored in a position that ensures the cap's shape remains consistent with that of a human head.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
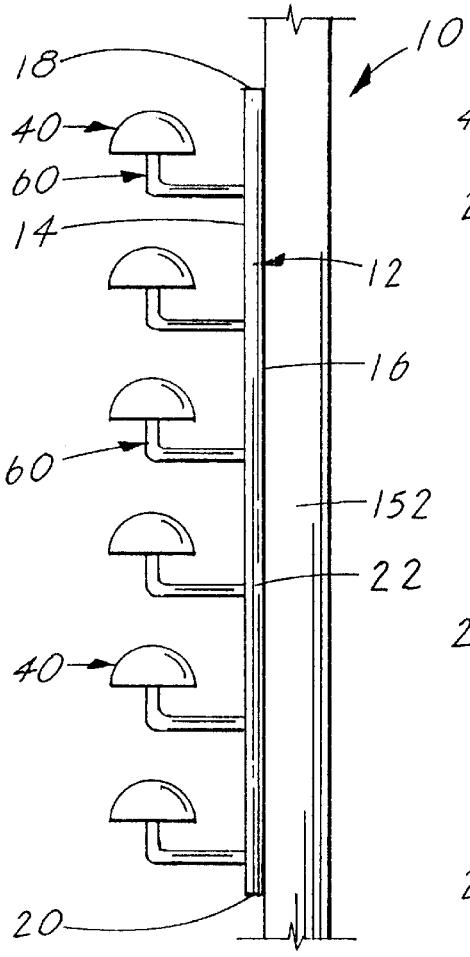
FIG. 1 is a side elevational view of the cap storage and display rack showing a base vertically attached to a flat surface and having six cap supports and six base/cap support attachment rods.

The best mode for carrying out the invention is presented in terms of a preferred embodiment for a cap storage and display rack. Although there is only one preferred embodiment for the cap storage and display rack, there are multiple design configurations. The invention is designed to allow one or more baseball-type caps 150 to be uniquely stored and/or displayed. While on the storage and display rack, the caps are maintained in a position which keeps the caps 150 in a wearable shape and allows whatever logo or indicia on the front of the cap to be clearly and easily seen.

All design configurations of the cap storage and display rack 10, hereinafter "rack 10", as shown in FIGS. 1–9, are comprised of the following major elements: a base 12, a cap support 40, a base/cap support attachment rod 60 having a base end 62 and a cap end 84, and a rod/base attachment structure 90.

Figure 2:
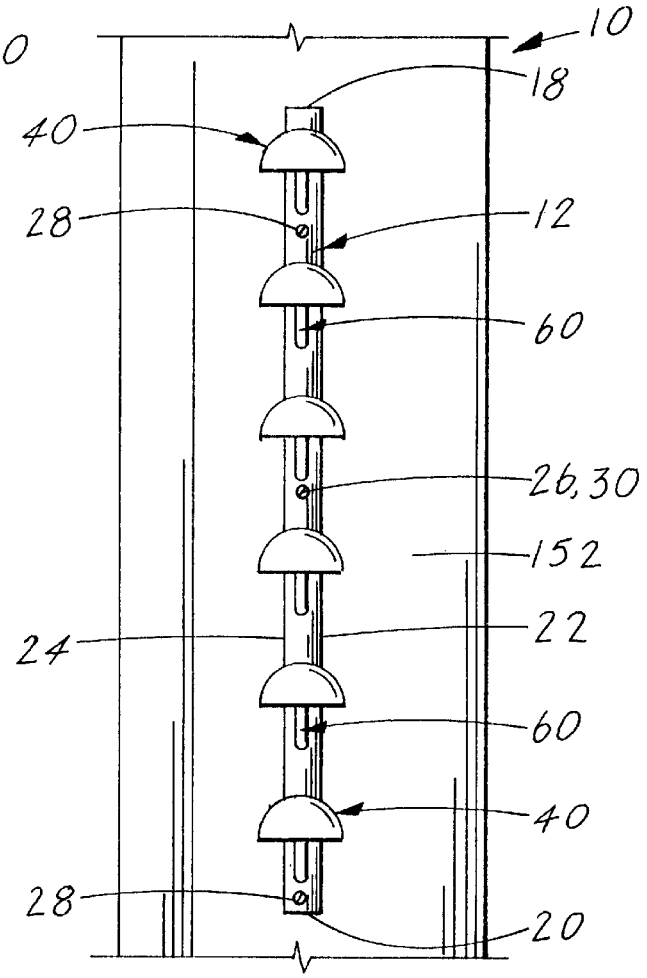
FIG. 2 is a front elevational view of the rack as described in FIG. 1.
Figure 3:
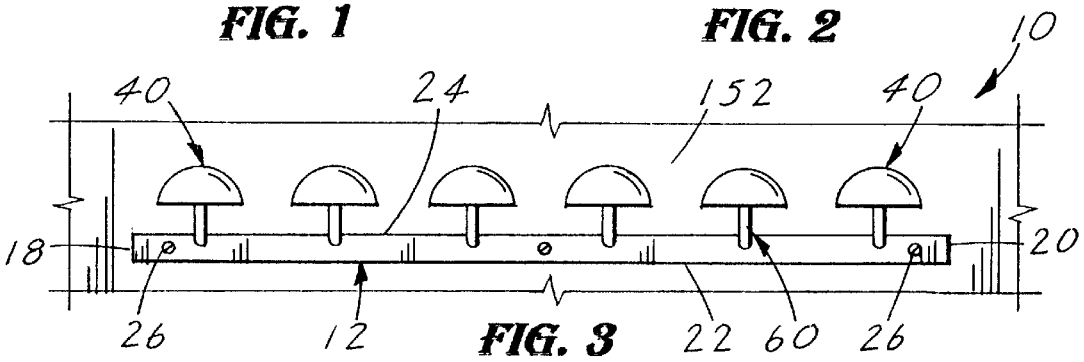
FIG. 3 is a front elevational view of a cap storage and display rack horizontally attached to a flat surface and having six cap supports and six base/cap support attachment rods.
Figure 4:
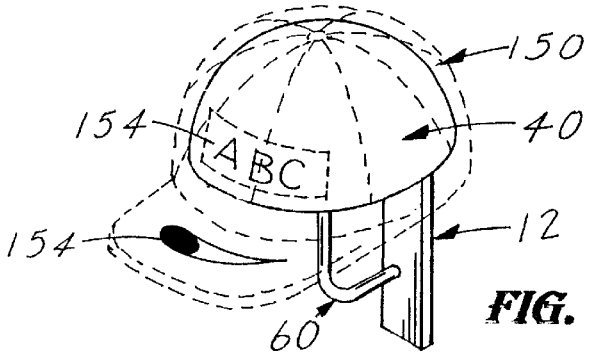
FIG. 4 is a perspective view showing in broken lines a baseball-type cap placed over a cap support.
Figure 5:
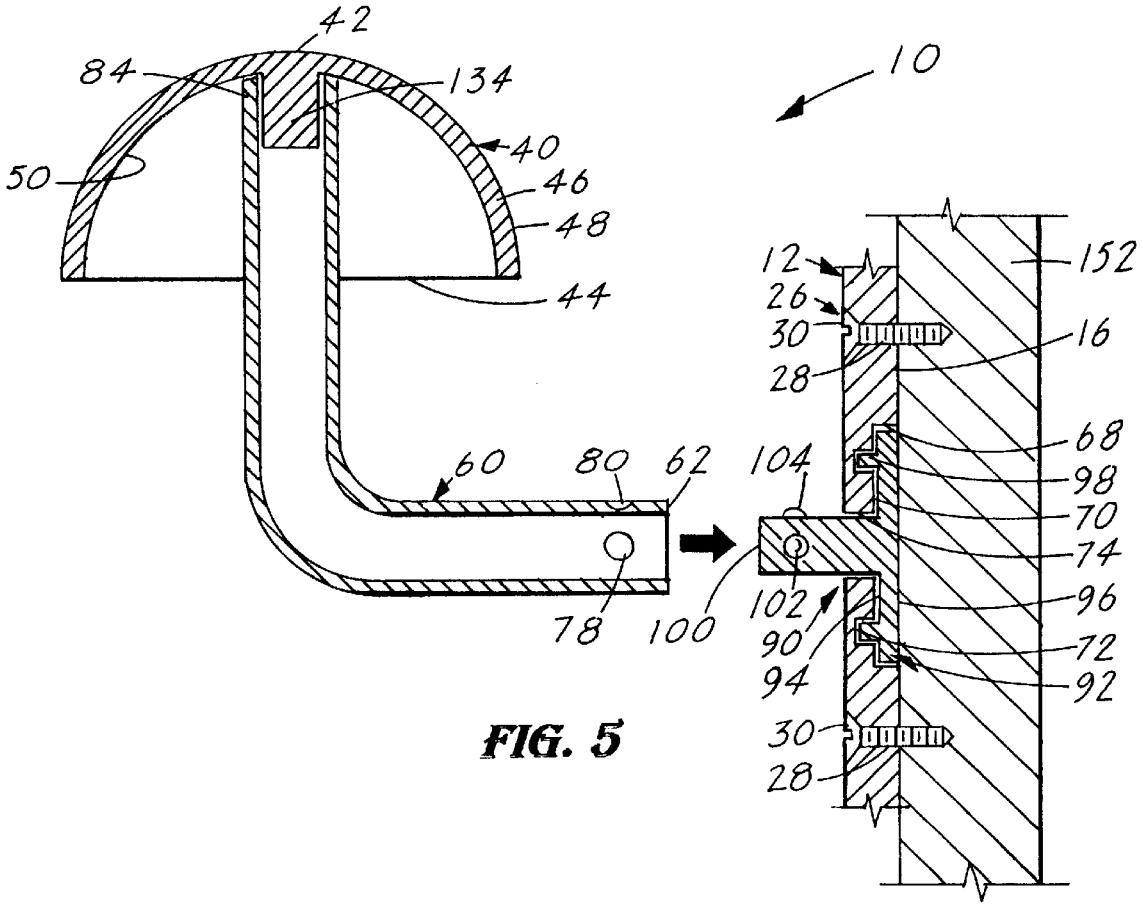
FIGS. 5 and 6 are sectional side views of a cap support stamped from a metal or plastic material to form a hemispheric shell, a base/cap support attachment rod formed from a tubular material, and a means for attaching and securing the base end of the base/cap support attachment rod to the base and the cap end to the cap support.
Figure 6:
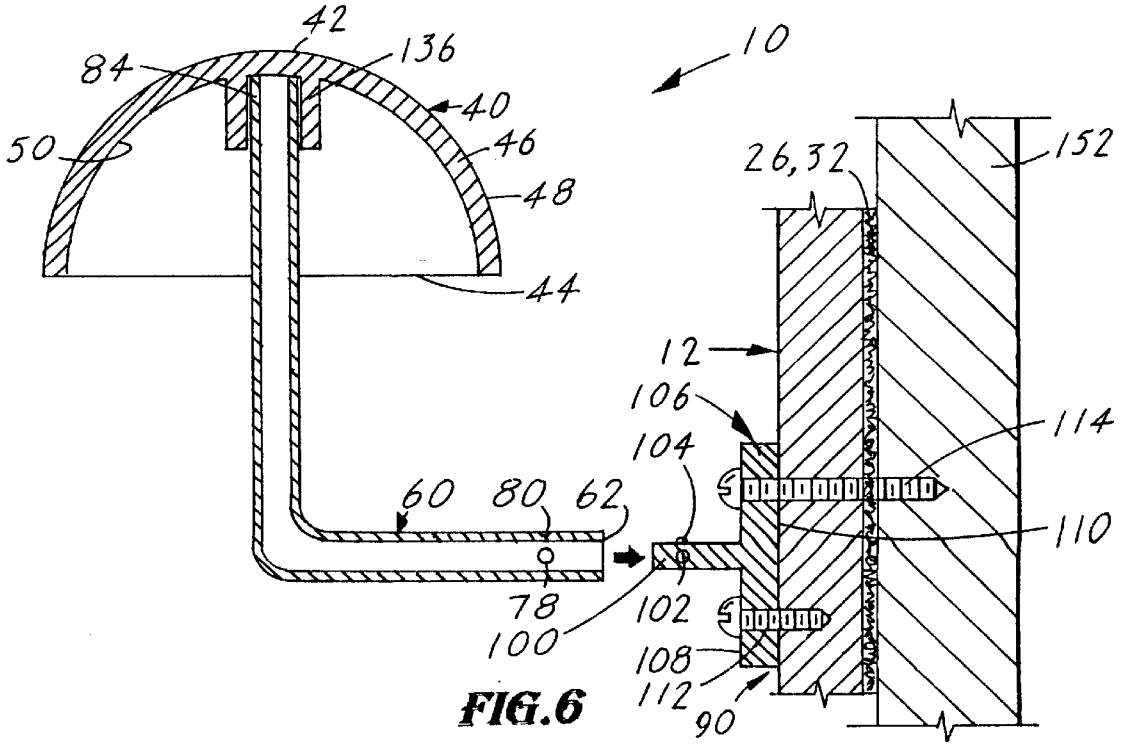

The base 12, as shown in FIGS. 1–9, has a length which allows from 1–24 caps, and preferably 6 caps, to be stored and displayed; and a width that is less than the diameter of the cap support 40. As shown in FIGS. 1, 2 and 3, the base 12 is comprised of a front surface 14, a rear surface 16, an upper edge 18, a lower edge 20, a first side edge 22, a second side edge 24, and attachment means 26. The base 12 can be mounted on a substantially flat surface 152 in either a vertical orientation as shown in FIGS. 1 and 2, or in a horizontal orientation, as shown in FIG. 3. The attachment means 26 for attaching the base 12 to the substantially flat surface 152 comprises a plurality of screw bores 28 located in the base 12 and spaced between the first and second edges 22,24 along the length of the base 12 as shown in FIGS. 2 and 3. A plurality of screws 30 are then inserted through the screw bores 28 and into the substantially flat surface 152, as shown in FIGS. 5, 7, 8 and 9. Also, for a more permanent attachment of the base 12 to the flat surface 152, an adhesive 32 can be applied between the rear surface 16 of the base 12 and the flat surface 152, as shown in FIG. 6.

In order to maintain the cap(s) 150 in a position similar to that of a human head, and to allow any indicia 154 applied to the front or bill of the cap 150 to be seen, the cap support 40 is utilized. The cap support 40, as shown in FIGS. 1–9, has a substantially hemispheric shape and is comprised of an upper surface 42 and a lower surface 44 and is dimensioned to allow the cap 150 to be placed over the cap support 40. There are two designs for the cap support 40 in the first design the cap support 40 is stamped from a metal or plastic material to form a hemispheric shell 46, as shown in FIGS. 5 and 6. The hemispheric shell 46 has an outer surface 48 and an inner surface 50 wherein the hemispheric shell shape allows a plurality of the cap supports 40 to be nested together during shipment. In a second design the cap support 40 is formed form a solid material 52.

There are five design configurations by which the base/cap support attachment rod 60 can be attached to the base 12 by use of the rod/base attachment structure 90. The base/cap support attachment rod 60, as shown in FIGS. 1–9, is formed from a tubular or a solid material and is comprised of a base end 62 and a cap end 84.

In the first design configuration, which is shown in FIG. 5, the base 12 has a flange cavity 68 which extends from the rear surface 16 of the base 12. The cavity 68 is comprised of an inner surface 70 which has a pair of pin cavities 72. A substantially centered protrusion bore 74 is located between the pair of pin cavities 72. In order to maintain the cap support 40 in position the rod/base attachment structure 90 is utilized.

The rod/base attachment structure 90 is comprised of a flange 92 having a front surface 94 and a rear surface 96. From the front surface 94 extends a pair of attachment pins 98, which are aligned to fit into the pin cavities 72 that are located on the flange cavity 68. An integral protrusion 100 projects outward from the center and the front surface 94 of the flange 92 that is dimensioned to fit into and extend outward from the substantially centered protrusion bore 74 located on the base 12. The protrusion 100 includes a first male detent 102, which is aligned between the upper and lower edges 18,20 of the base, and a second male detent 104, which is aligned between the first and second side edges 22,24 of the base 12. The base/cap support attachment rod 60 has on the base end 62 a first female detent 78 and a second female detent 80. Both detents 74,80 are aligned and spaced such that when the base end 62 of the attachment rod 60 is inserted over the protrusion 100 on the attachment structure 90, the first and second female detents 78,80 interface with the respective first and second male detents 102,104. Once all the detents 78,80 and 102,104 have interface, the base end 62 of the attachment rod 60 is secured to the base 12, in either a vertical or horizontal orientation.

The second design configuration is shown in FIG. 6. In the second design the rod/base attachment structure 90 comprises a flange 106 having a front surface 108 and a rear surface 110. The flange 106 has at least two screw bores 112, wherein into each bore 112 is inserted a screw 114. The screw 114 penetrates into the base 12, or through the base and into the substantially flat surface 152. Substantially centered and extending outward from the front surface 108 of the flange 106 is the integral protrusion 100. The protrusion 100 has the first male detent 102 and the second male detent 104 configured in the same manner as the first design configuration. Similarly, the base end 62 of the base/cap support attachment rod 60 has the first and second female detents 78,80. As in the first design configuration, the base/cap support attachment rod 60 is inserted over the protrusion 100 on the attachment structure 90. The female detents 78,80 interface with the respective male detents 102,104 thereby securing the base end 62 of the attachment rod 60 to the base 12, in either a vertical or horizontal orientation.

Figure 7:
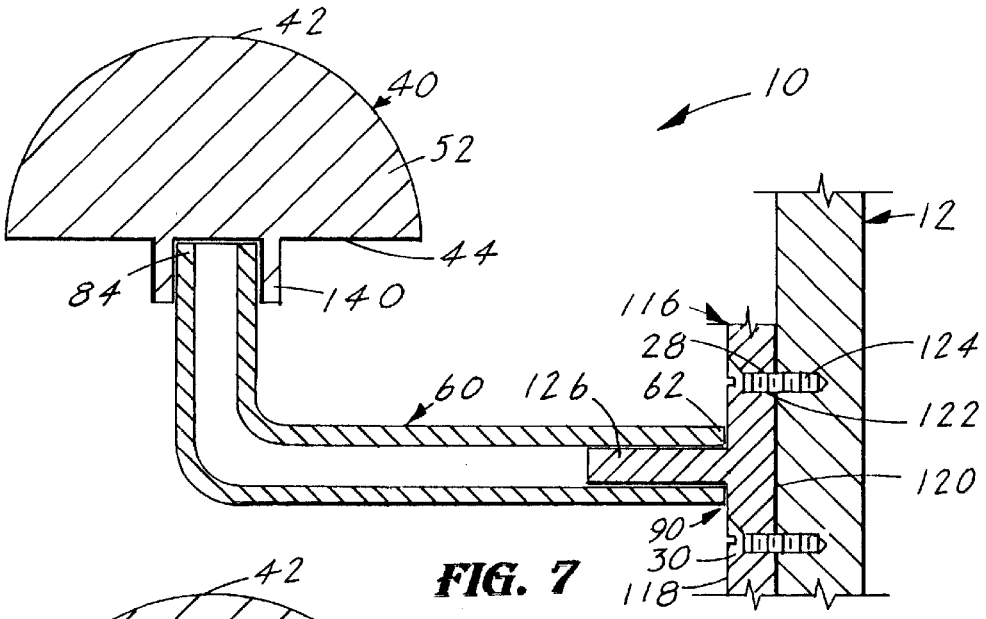
FIG. 7 is a sectional side view of a cap support made of a solid material to form a hemispheric shape, a base/cap support attachment rod formed from a tubular material, and a means for attaching and securing the base end of the base/cap support attachment rod to the base and the cap end to the cap support.

The third design configuration is shown in FIG. 7. In the third design configuration the rod/base attachment structure 90 comprises a flange 116 having a front surface 118 and a rear surface 120. The flange 116 has at least two screw bores 122 wherein into each bore 122 is inserted a screw 124, which penetrates into the base 12. Substantially centered and extending outward from the front surface 118 of the flange 116 is an integral protrusion 126. The base/cap support attachment rod 60 in the third design is formed from a tubular material having an inside circumference dimensioned to frictionally fit over the protrusion 126 on the attachment structure 90. Once the attachment rod 60 encompasses protrusion 126, the base end 62 of the attachment rod 60 is secured to the base 12, in either a vertical or horizontal orientation.

Figure 8:
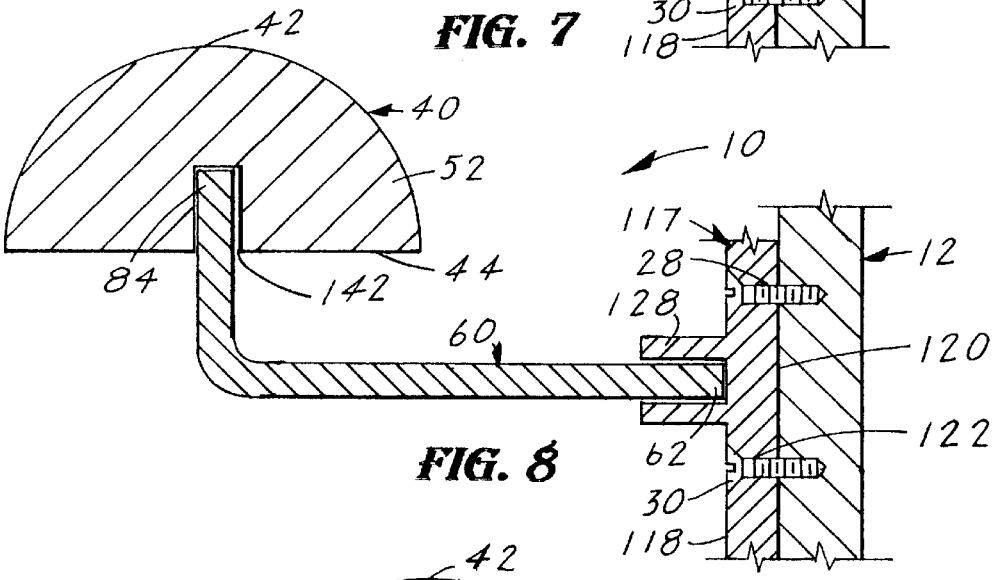
FIGS. 8 and 9 are sectional side views showing a cap support made of a solid material to form a hemispheric shape, a base/cap support attachment rod formed from a solid material, and means for attaching and securing the base end of the base/cap support attachment rod to the base and the cap end to the cap support.

The fourth design configuration is shown in FIG. 8. The fourth design is comprised of essentially the same elements as the third design with the exception that the integral protrusion 126 is replaced by an integral sleeve 128. The sleeve 128 is substantially centered on and extends outward form the front surface 118 of a flange 117. The sleeve 128 has an inner circumference dimensioned to frictionally receive and secure the base end 62 of either a tubular or solid base/cap support attachment rod 60 to the base 12, in either a vertical or horizontal orientation.

Figure 9:
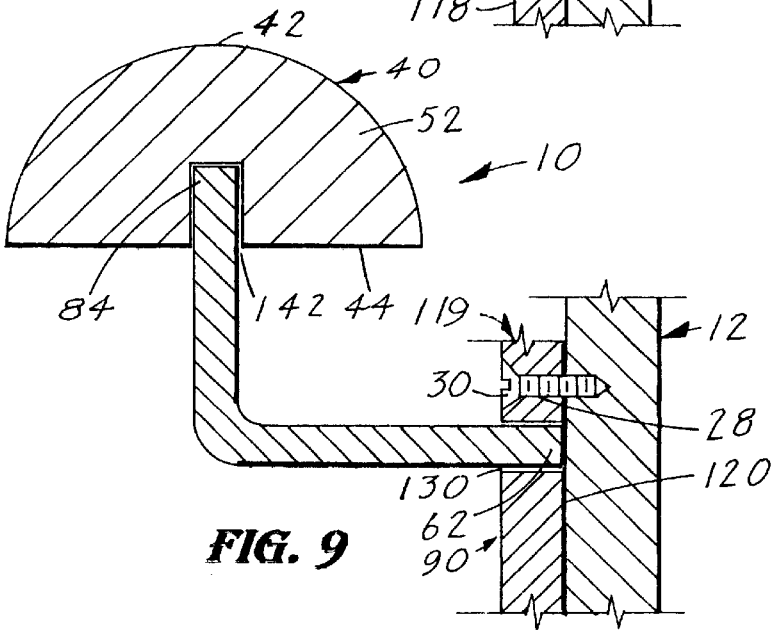

The fifth design configuration is shown in FIG. 9. In the fifth design the base 12 has an attachment structure 90 that includes a flange 119 having a plurality of longitudinally spaced bores 130. The base end 62 of the base/cap support attachment rod 60 is dimensioned to frictionally fit into the bores 130, in either a vertical or horizontal orientation.

Just as there are five design configurations for attaching and securing the base end 62 of the base/cap support attachment rod 60 to the base 12, there are four design configurations for attaching and securing the cap end 84 of the attachment rod 60 to the cap support 40.

The first design configuration is shown in FIG. 5. In the first design, the cap support 40 is comprised of the hemispheric shell 46 and has attached a substantially centered integral protrusion 134, which extends from the inner surface 50. The base/cap support attachment rod 60 is formed from a tubular material and has an inner diameter that frictionally fits over the protrusion 134.

The second design configuration is shown in FIG. 6. In the second design the cap support 40 comprises the hemispheric shell 46 and has attached a substantially centered sleeve 136, which centrally extends from the inner surface 50. The base/cap support attachment rod 60 can be formed from either a tubular or a solid material, and has an outer diameter that frictionally fits into the sleeve 136.

The third design configuration is shown in FIG. 7. In the third design the cap support 40 is constructed of a solid material 52 and has a substantially centered rod sleeve 140 centrally extending from the lower surface 44. The base/cap support attachment rod 60 can be formed from either a tubular or a solid material and has an outer diameter which fits into the rod sleeve 140 on the cap support 40.

The fourth design configuration is shown in FIGS. 8 and 9. In the fourth design the cap support 40 is constructed of a solid material 52 and has a substantially centered rod cavity 142 extending from the lower surface 44. The base/cap support attachment rod 60 can be formed from either a tubular or solid material has an outer diameter which fits into the rod cavity 142.

While the invention has been described in complete detail and pictorially shown in the accompanying drawings it is not to be limited to such details, since many changes and modifications may be made in the invention with departing from the spirit and scope thereof. For example, the elements of the rack 10 can be made with a metal, wood or plastic and a set screw can be used to further secure the base end 62 of the base/cap support attachment rod 60 to the integral protrusion 126 as shown in FIG. 7 or the integral sleeve 128 as shown in FIG. 8. Hence, it is described to cover any and all modifications and forms which may come within the language and scope of the appended claims.

What is claimed is:

1. A cap storage and display rack comprising:

a) a base having a front surface, a rear surface, an upper edge, a lower edge, a first side edge, a second side edge, and a means for being attached to a substantially flat surface, b) a cap support having an upper surface and a lower surface dimensioned to allow a cap to be placed over said cap support and c) a base/cap support attachment rod having a base end and a cap, end, wherein the base end includes a means for being attached and secured to said base in either a vertical or horizontal orientation and wherein the cap end includes a means for being attached and secured to said cap support and wherein said means for attaching and securing the base end of said base/cap support attachment rod to said base comprises:

(1) said base having a flange cavity which extends from the rear surface of said base with the inner surface of the cavity having a pair of pin cavities and having a substantially centered protrusion bore located between the pair of pin cavities, (2) a rod/base attachment structure comprising:

(a) a flange having a front surface and a rear surface, wherein from the front surface extends a pair of attachment pins aligned to fit into the pin cavities located in the flange cavity, (b) an integral protrusion projecting outward from the center and the front surface of the flange that is dimensioned to fit into and extend outward from the substantially centered protrusion bore located on said base, wherein the protrusion includes a first male detent aligned between the upper and lower edges of said base and a second male detent aligned between the first and second side edges of said base, and (3) said base/cap support attachment rod having on the base end a first female detent and a second female detent, wherein the first and second female detents are aligned and spaced such that when the base end of said base/cap support attachment rod is maneuvered onto the protrusion of said rod/base attachment structure, the first and second female detents interface with the respective first and second male detents to secure the base end of said base/cap support attachment rod to said base in either a vertical or a horizontal orientation.

2. A cap storage and display rack designed to be vertically or horizontally attached to a substantially flat surface, said rack comprising:

a) a base having:

(1) a front surface, a rear surface, an upper edge, a lower edge, a first side edge and a second side edge, (2) a flange cavity which extends from the rear surface of said base with the inner surface of the cavity further having pair of pin cavities and a substantially centered protrusion bore located between the pair of pin cavities, (3) a plurality of screw bores spaced between the first and second side edges and along the length of said base where into the screw bores is inserted a like plurality of screws which penetrate the substantially flat surface to secure said base to the flat surface, b) a rod/base attachment structure comprising:

(1) a flange having a front surface and a rear surface, wherein from the front surface extends a pair of attachment pins aligned to fit into the pin cavities located in the flange cavity, (2) an integral protrusion projecting outward from the center and the front surface of the flange that is dimensioned to fit into and extend outward from the substantially centered protrusion bore located on said base, wherein the protrusion includes a first male detent aligned between the upper and lower edges of said base and a second male detent aligned between the first and second side edges of said base, c) a cap support stamped from a metal or plastic material to form a hemispheric shell having an outer surface and an inner surface that is dimensioned to allow a baseball-type cap to be placed over the outer surface, wherein from the inner surface extends a substantially centered integral protrusion, d) a base/cap support attachment rod formed from a tubular material having:

(1) a base end having a first female detent and a second female detent which are aligned and spaced such that when the base end is maneuvered onto the protrusion of said rod/base attachment structure, the first and second female detents interface with the respective first and second male detents to secure the base end of said base/cap support attachment rod to said base, and (2) a cap having an inside diameter that frictionally fits over the protrusion on said cap surface to secure the cap end of said base/cap support attachment rod to said cap support, wherein said base has a length to accommodate a plurality of said base/cap attachment rods and said cap supports to allow a like plurality of caps to be stored and displayed.

* * * * *